US007152255B2

(12) United States Patent
Welden

(10) Patent No.: US 7,152,255 B2
(45) Date of Patent: Dec. 26, 2006

(54) SWIMMING POOL RETURN FLOW NOZZLE

(75) Inventor: Wesley T. Welden, St. Petersburg, FL (US)

(73) Assignee: Welden Enterprises, Inc., St. Petersburg, FL (US)

( * ) Notice: Subject to any disclaimer, the term of this patent is extended or adjusted under 35 U.S.C. 154(b) by 0 days.

(21) Appl. No.: 11/352,822

(22) Filed: Feb. 13, 2006

(65) Prior Publication Data

US 2006/0123537 A1 Jun. 15, 2006

Related U.S. Application Data

(63) Continuation-in-part of application No. 10/850,727, filed on May 21, 2004.

(60) Provisional application No. 60/480,211, filed on Jun. 20, 2003.

(51) Int. Cl.
*E04H 4/00* (2006.01)

(52) U.S. Cl. ..... 4/507; 4/490; 239/206

(58) Field of Classification Search ..... 4/490, 4/507, 541.1, 541.3, 541.6; 239/206, 240
See application file for complete search history.

(56) References Cited

U.S. PATENT DOCUMENTS 3,521,304 A 7/1970 Ghiz
4,188,673 A * 2/1980 Carter ..... 4/490
4,202,499 A 5/1980 Mathews
4,271,541 A * 6/1981 Mathews ..... 4/490
4,559,653 A * 12/1985 Mathews ..... 4/541.6
6,419,840 B1 * 7/2002 Meincke ..... 4/507
2006/0123537 A1 * 6/2006 Welden ..... 4/507

* cited by examiner

*Primary Examiner*—Tuan Nguyen
(74) *Attorney, Agent, or Firm*—Dennis G. LaPointe

(57) ABSTRACT

A pool return nozzle assembly, wherein water enters through the gear sleeve assembly causing the turbine blade assembly to turn, which then causes the oscillation of the gear assembly and which then contributes to the revolution of the rotor head for smooth rotation. The assembly focuses on circulating water along the walls of the pool down to the radius and floor of the pool; therefore, enhancing the effectiveness of pool cleaning and return distribution of the water to the pool. The assembly can also be converted into a water fountain with its optional fountain design, which includes a spray head to create aesthetic water spray and fountain characteristics. Internal components are configured to allow water passageways that will direct sand particulates away from working components thereby providing a self-cleaning capability.

14 Claims, 12 Drawing Sheets

SWIMMING POOL RETURN FLOW NOZZLE

RELATED APPLICATION

This application is a continuation-in-part of U.S. patent application Ser. No. 10/850,727 filed May 21, 2004, which claims priority of U.S. provisional application Ser. No. 60/480,211 filed Jun. 20, 2003.

FIELD OF THE INVENTION

The invention relates to an apparatus for diverting water in more than one direction continuously through return flow jets or nozzles at the wall of a swimming pool and optionally for the aeration of the return water by forming a fountain with the apparatus.

BACKGROUND OF THE INVENTION

Most in-ground swimming pools have two or more return lines either on the wall of the pool (generally about 6 inches below the tile line) or along the floor (as with in-floor cleaning systems), or with the latter, a wall return port may also be included such as near the steps.

For conventional wall return ports, the return is a fixed unit, which is only a cover or collar insert for the PVC pipe entering into the pool, with a smaller aperture or orifice to inject water into the pool in one fixed direction or a manually adjustable fixed direction.

SUMMARY OF THE INVENTION

The present invention is a rotating device that can be attached to the return of a swimming pool. While the conventional return is a fixed unit as mentioned above, the present invention has means for diverting the return water through the return port of the pool in a continuous rotating multi-directional pattern. The apparatus has a housing for a water flow driven gear system, which causes the rotor head to turn freely. Ball bearing washer assemblies may also be incorporated to minimize friction, or other means to minimize surface drag or friction between two rotating adjacent parts may be incorporated, such as small spaced-apart ridges forming relatively thin ledges that separate two adjacent rotating surfaces. In the latter case, the ridges are preferably relatively fine or thin in thickness, thereby allowing only the thin edge to contact the adjacent rotating surface. Of course, the water itself will lubricate and cool friction surfaces.

The water enters through the gear sleeve assembly causing the turbine blade assembly to turn, which then causes the oscillation of the gear assembly itself, and which then contributes to the revolution of the rotor head to obtain a continuous smooth rotation. The outlet may be radially directed from the rotating head assembly at the distal end of the apparatus or it may be through a flow tube assembly extending radially from the outlet on the rotating head assembly. The outlet at the end of the flow tube assembly may be directed in any desired direction, such as through an aperture that sprays the water over a desired angular pattern such as a 60 degree pattern at a desired angular direction relative to the pool water, for example, at an approximate 45 degree direction toward the pool water. Further, the opening at the outlet may be designed to produce desired aesthetic effects or patterns in the water spray, for example, by using a plurality of small apertures.

In an another embodiment, the invention is configured to eliminate sand particle accumulation therein providing for self-cleaning capabilities using enhanced water flow paths around and/or through the gear system, the drive gear, flow nozzle, nozzle retainer nut and bottom plate. It was found that in some circumstances, a sand particulate might hang up the drive gear and occasionally the gear system thereby requiring more frequent removal and cleaning of the invention. Notwithstanding the fact that the invention as described above and in the parent application, which is incorporated by reference herein, works extremely well, this enhanced self-cleaning aspect of the improved embodiment described herein significantly reduces the need for frequent cleaning of the invention.

This assembly also has an optional fountain design using the flow tube assembly extending radially from a distal end of the apparatus or using the outlet radially directed from the rotating head assembly at the distal end of the apparatus. The flow tube assembly typically has a spray head nozzle at its distal end to create aesthetic features, such as the pattern of spray mentioned above. In the latter case, the rotation can be stopped with locking means known in the art, to allow for the fountain like feature. A set screw or other mechanism can accomplish this locking feature. Even when he flow tube assembly is not being used, the outlet of the apparatus can be adapted to discharge the water in a fixed single direction using similar locking means.

The performance of this assembly will enable an existing swimming pool to run much more efficiently encompassing a variety of positive attributes. The area of the circulation of water is greatly increased by diverting the water in more that one direction. By allowing the water to move in many directions on a continuous basis, the chemicals needed to maintain the clarity and purity of the water are disbursed more fluently and effectively, greatly enhancing the quality of the water. The present invention allows the chemicals to be injected down deep into the water with great motion and on a rotating basis throughout the pool. This rotation motion carries a wider and broader purification and distribution area.

Heating the pool becomes more cost efficient because of the returning water entering the pool in deeper areas causing less heat loss on the surface of the water. There is also a faster distribution of heat throughout the entire pool. The aeration of the water created by the use of the optional fountain feature will cool down the water if it gets too warm.

Cleaning of the swimming pool water becomes virtually effortless with the thrusting water shooting down the walls of the pool. With the pressure of the streaming water, the dirt is dislodged from the pool walls and suspended into the water for the main drain or skimmer to evacuate into the filter. The flowing water actually breaks the surface of the water to accentuate the skimming action of the pool.

The in-floor cleaning system works by moving water only on the bottom of the pool, where the rotating wall assembly focuses on circulating water along the walls of the pool down to the radius and floor of the pool therefore enhancing the effectiveness of pool cleaning.

In addition, the calming sounds of the water cascading from the optional fountain gives a swimming pool a tranquil environment for enhanced relaxation. This optional feature gives any pool owner the option of an aesthetically pleasing fountain at any time even after the pool is totally installed. The pool wall mounted present invention also makes it extremely effortless to create an attractive environment of a waterfall at any time, and is easily returned to an effective cleaning and circulation device in just moments. Anyone with little or no knowledge of a swimming pool can install the present invention, including its optional fountain with the greatest of ease.

DETAILED DESCRIPTION OF THE INVENTION

Figure 1B:
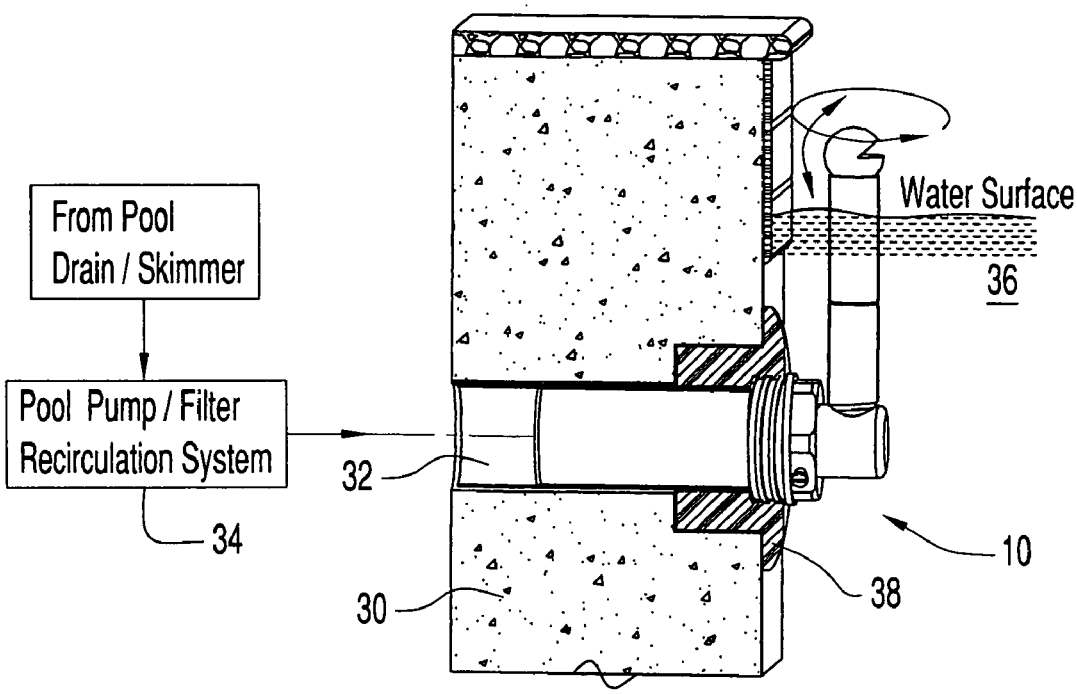
FIG. 1*b* is a partial cross-sectional view of a pool wall depicting a representative installation of another embodiment of the present invention installed in the pool wall.
Figure 1A:
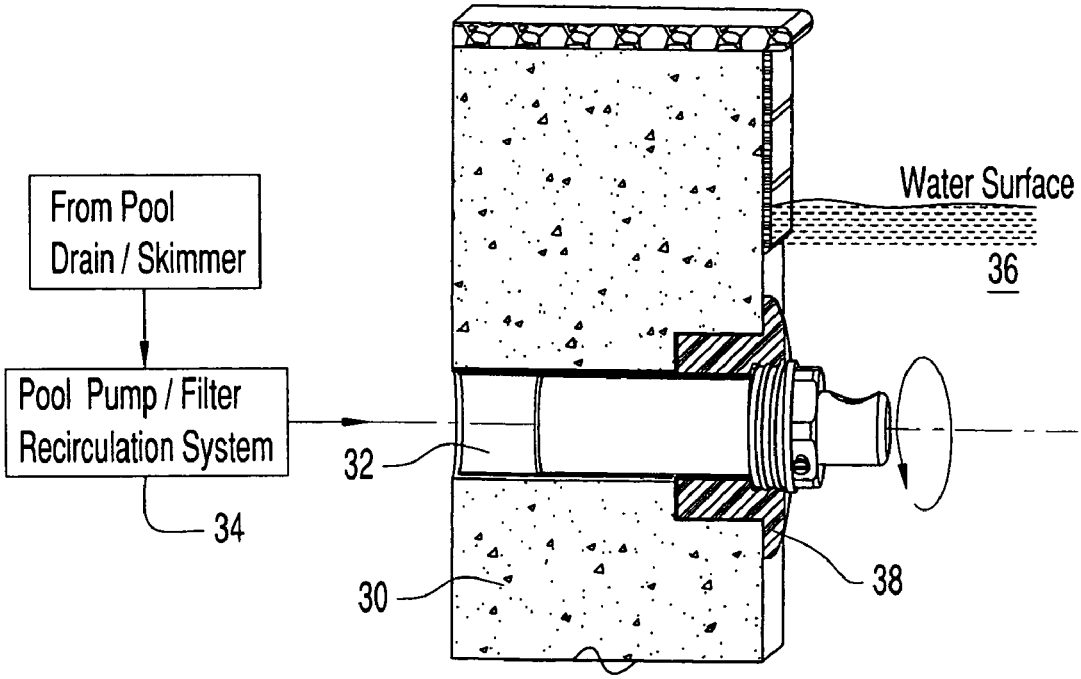
FIG. 1*a* is a partial cross-sectional view of a pool wall depicting a representative installation of one embodiment of the present invention installed in the pool wall.
Figure 2:
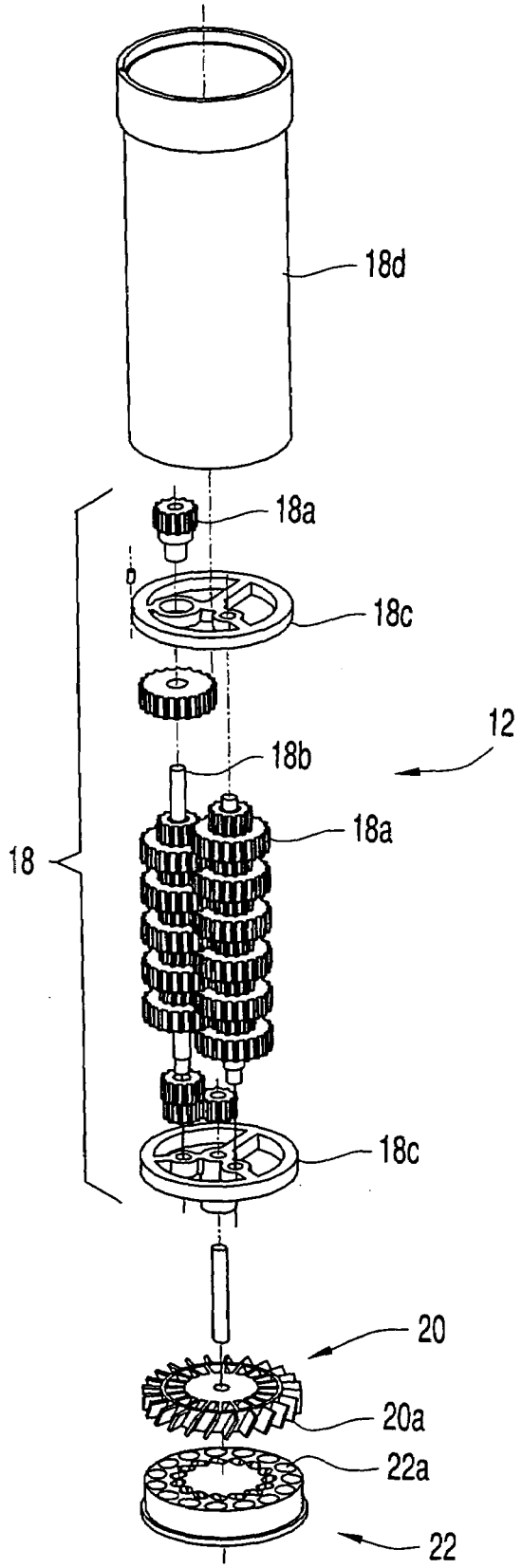
FIG. 2 is an exploded view of a typical assembly of the major components of the present invention.
Figure 3:
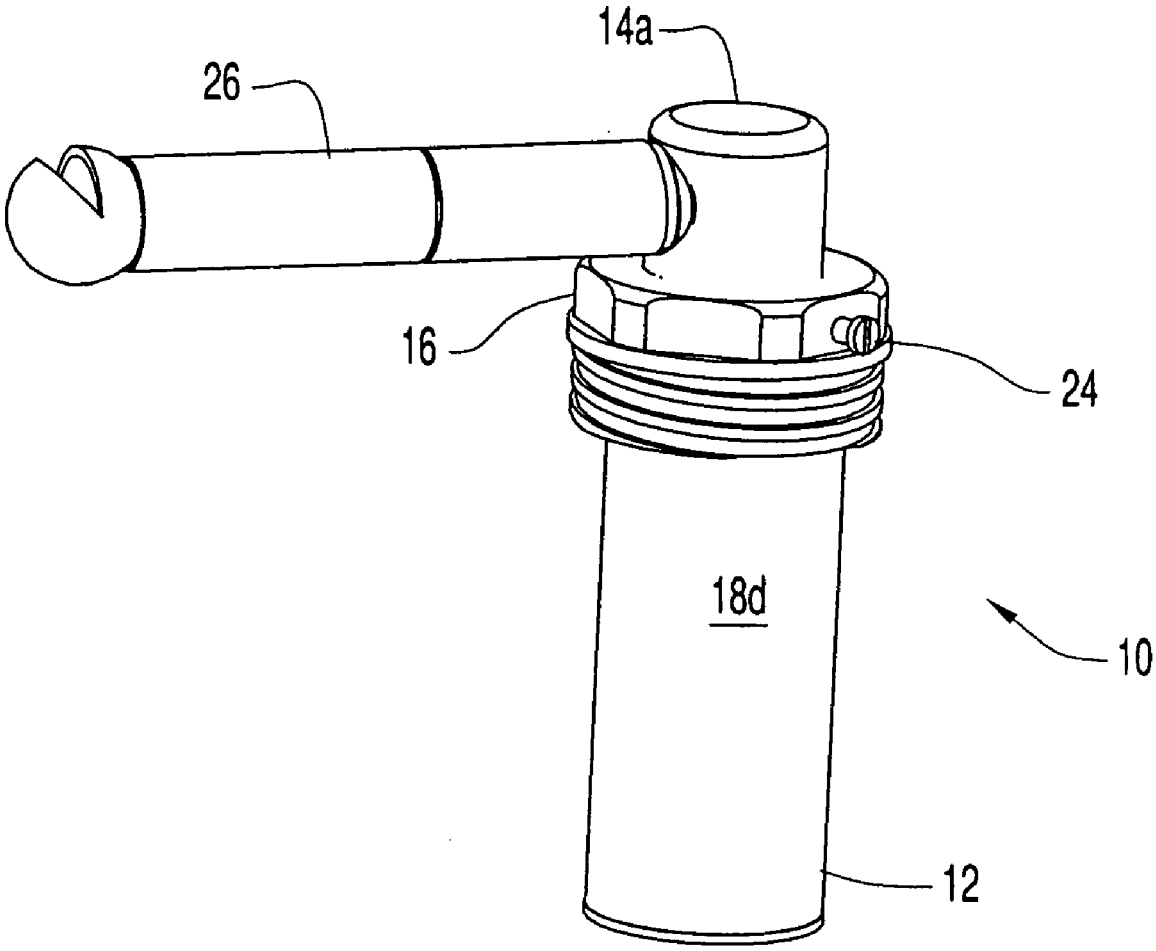
FIG. 3 is a view of the assembled invention depiction the embodiment of FIG. 1*b*, where an extended flow tube assembly that can be fixed to create a water fountain.
Figure 5:
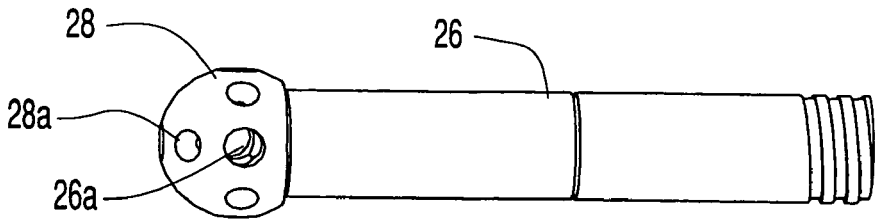
FIG. 5 is a depiction of the extended flow tube assembly only depicting another example of a spray outlet, that is, a plurality of apertures to generate a finer spray pattern.
Figure 4:
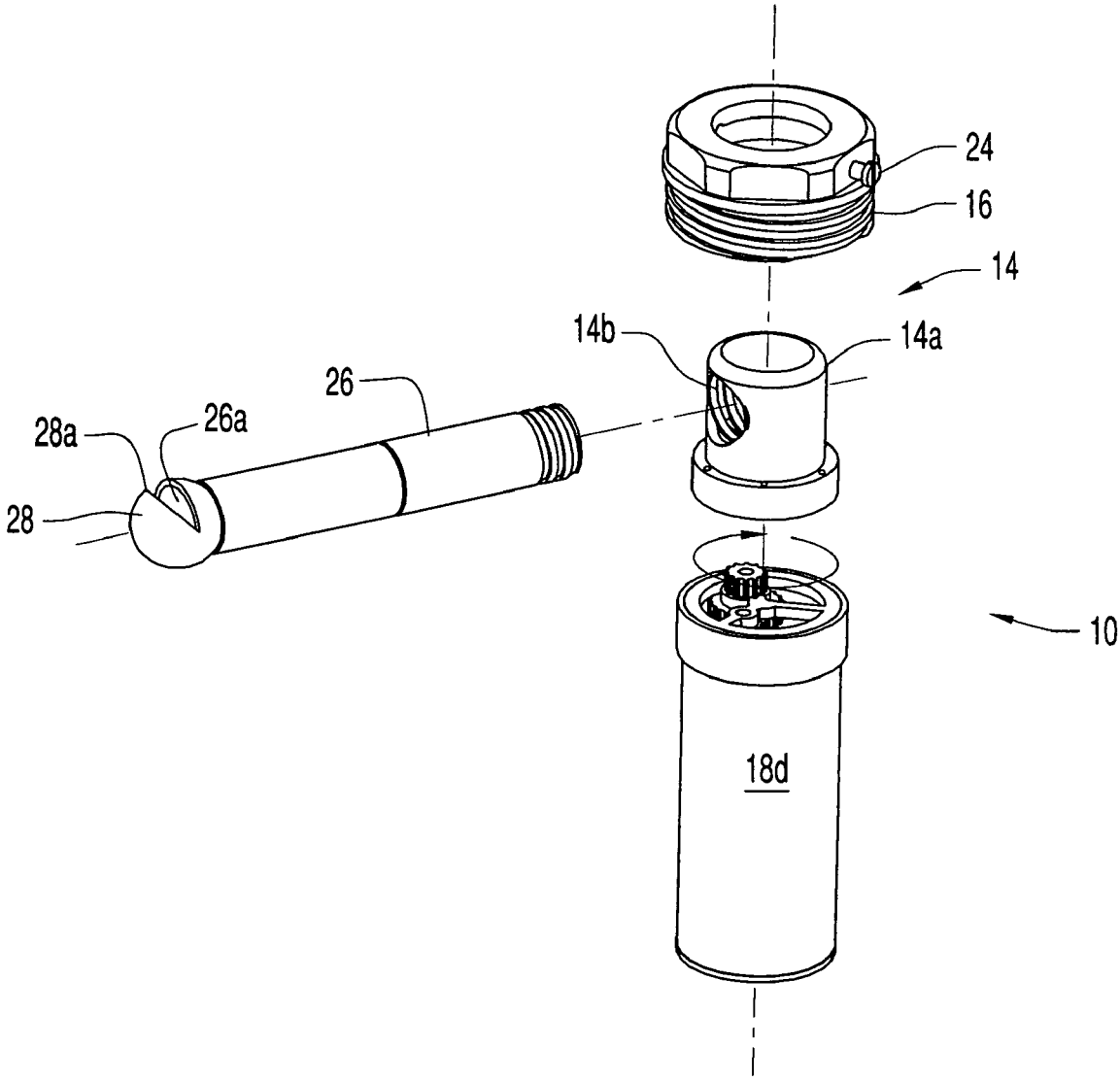
FIG. 4 is an exploded view of the components of the present invention, including a depiction of the insertion of the extended flow tube assembly with a quarter moon shaped opening at the end of the flow tube assembly as an example only of a typical spray outlet.

As shown in FIGS. 1*a* and 1*b*, the invention is a pool return flow nozzle assembly and is generally depicted as 10. As shown in FIGS. 2–4, the invention includes means 12 for diverting a return water from a pool water circulation system 34 back into a pool 36 in a continuous rotating multi-directional pattern, as shown by the rotating arrow symbol in FIG. 1*a*.

The means 12 for diverting the return water causes a continuous rotation of a rotatable head assembly 14 at a distal end of the pool return flow nozzle assembly 10. The rotatable head assembly 14 including a rotor head 14*a* having an outlet port 14*b* through which the return water is directed into the pool 36 in the continuous rotating multi-directional pattern. The outlet port 14*b* shown in the drawings is circular in shape; however, it may be oval or instead be an array of apertures to distribute the return water in any desired pattern.

The invention includes means 16 for securing the pool return flow nozzle assembly 10 into a return outlet 32 on a wall 30 of the pool 36. Most wall port or jets have a threaded collar or fitting, similar to fitting 38, inserted in the wall 30. The present invention housing 18*d* would simply have a mating connection to secure the invention 10 in the wall port or outlet 32. Such threaded connections for pool devices are known in the art. For example, hoses for pool cleaners that connect to the wall port 32 generally have a very coarse threaded connection and rubber o-ring seal that allows for a simple engagement of insertion pass the first thread and a twist of the of the hose fitting for securement.

Means 12 for diverting the return water includes a water flow driven gear system 18 in mechanical communication with the rotatable head assembly 14. The water flow driven gear assembly 18 is typically an assembly of gears 18*a* of the same or different styles mounted on shafts 18*b* and aligned within the housing 18*d* with guide or gear shaft alignment end plates 18*c*. There are many ways known in the art to assemble gears to perform the desired features and the illustrations are merely exemplary in nature. The end plates 18*c* may also be provided for each of assembly and manufacture such that the one closest the rotatable head assembly 14 is molded integrally inside housing 18*d*. The gear arrangement depicted in the drawings are only intended to be exemplary in nature. For example, a portion of the mating gears could be incorporated integrally to the inside surface of sleeve 18*d*. Further, in another typical arrangement, the sleeve 18*d* could be eliminated and means 16 for securement to the wall outlet 32 can be attached directly to the wall fitting with the gear assembly connected directly to the rotor head assembly 14.

The means 12 for diverting the return water includes a turbine blade assembly 20 in mechanical communication with the water flow driven gear system 18. The turbine blade assembly 20 shown in the drawings is also exemplary in nature. The style and structure can vary, as well as the angle of the blades 20*a*.

The inlet into the means 12 for diverting the return water further includes means 22 for channeling the return water in a desired pattern toward the turbine blades 20*a* of a turbine blade assembly 20. The channeling means 22 is preferably a plurality of apertures 22*a* in a predetermined array. Although the apertures may be axially aligned with the housing 18*d*, in order to enhance the capture of the water flow onto the blades 20*a* of the turbine blade assembly 20, the apertures 22*a* may be oriented through the face of the inlet at an angle so as to direct the water toward the surface of the blades 20*a*.

When it is desired to stop the rotation of the rotor head 14*a*, locking means 24 for holding the rotor head 14*a* in a fixed direction may be optionally provided. This can be done in a number of ways known in the art. For example, the drawings show a screw that may be turned against a flat surface (not shown) of the rotor head 14*a*. Typically, the screw would have a flat end (not shown) that sets against the flat surface to stop rotation. Alternatively, another example is the use of pins or spring-loaded pins for stopping the rotation.

Means 16 for securing the pool return flow nozzle assembly 10 into a return outlet 32 on a wall 30 of the pool 36 may be secured to the inventive nozzle sleeve 18*d* by threads (not shown) or by screws in a keyway (not shown) or by other means known in the art, including permanent adhesive bonding or PVC welding.

When fountain like features are desirable, the assembly 10 can incorporate a flow tube assembly 26, as shown in FIGS. 1*b* and FIGS. 3–5. The flow tube assembly 26 would be securable to the outlet port 14*b* of the rotor head 14*a*. The flow tube assembly 26 has its own outlet port 26*a* at its distal end, which is in fluid communication with the outlet port 14*b* on the rotor head 14*a*. The outlet portion of the flow tube assembly is preferably directionally adjustable up and down as well as rotationally as representationally depicted by the arrows in FIG. 1*b*.

The flow tube assembly 26 extends radially from the rotor head 14*a* a predetermined distance from the rotor head 14*a* located at the distal end of the return flow nozzle assembly 10. The flow tube assembly outlet port 26*a* includes means 28 for directing the water in a desired pattern back into the pool. The means 28 for directing the water in the desired pattern back into the pool includes one or more apertures 28*a* designed to spray the water back into the pool in a spray pattern, the location, size and number of apertures 28*a* being selected to obtain a desired aesthetic flow of water through the flow tube assembly outlet port 26*a*.

FIGS. 7 through 10 describe another embodiment designed to provide a self-cleaning characteristic to the invention.

Figure 6B:
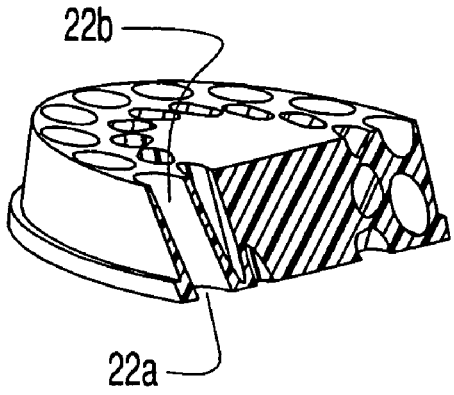
FIG. 6*b* is a cross-sectional view of the channeling component depicted in FIG. 6*a;*
Figure 6A:
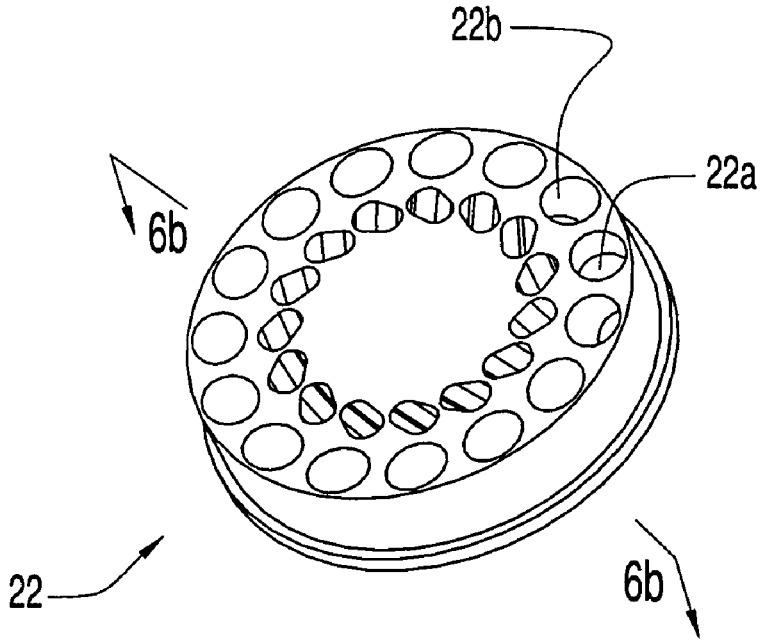
FIG. 6*a* is a depiction of a typical example of an inlet channeling component which can have apertures aligned with the axis of the invention and angled so as to direct the water more perpendicularly against the typically angled turbine blades.
Figure 7:
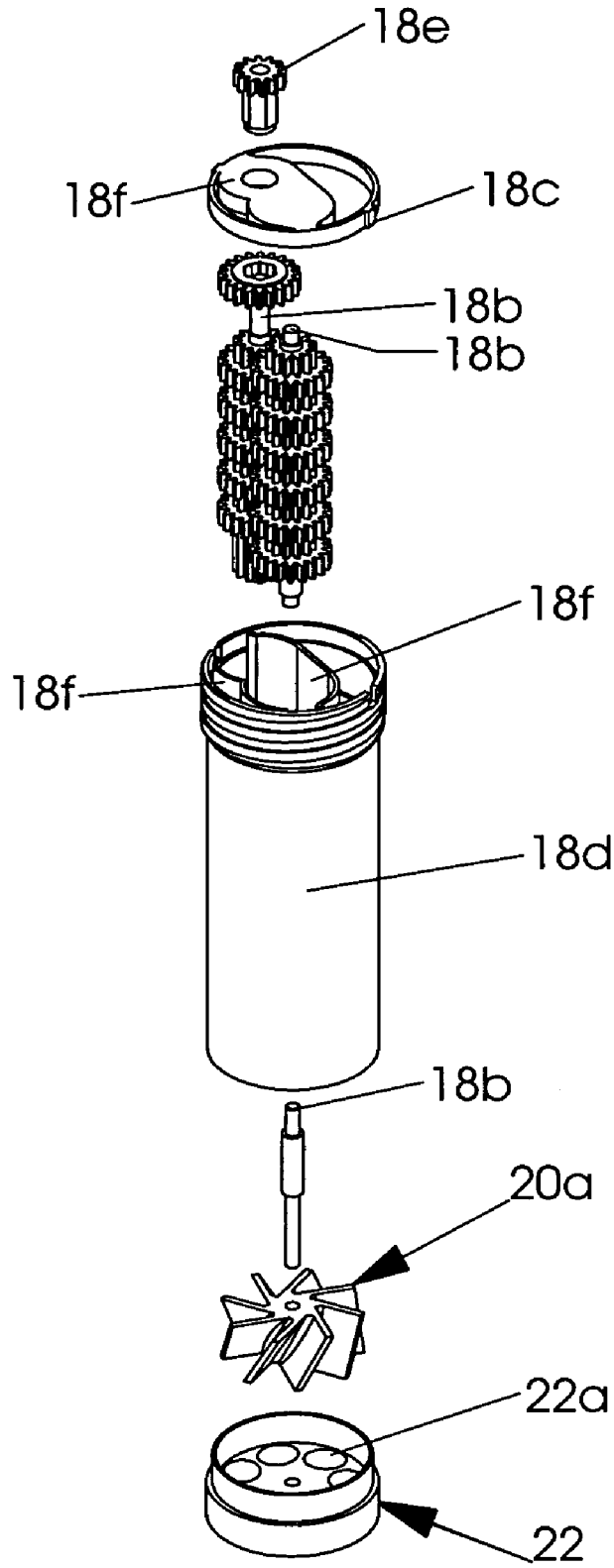
FIG. 7 is an exploded view depiction of an example of another embodiment of the invention.

FIG. 7 is an exploded view depiction of an example of this other embodiment of the invention. In this embodiment, the gear shaft alignment ends 18*c* of the embodiments of FIGS. 1–6 has been modified to be incorporated into or assembled to configured to be part of an internal encapsulating housing 18*f* for the majority of the gear assembly 18.

Figure 8:
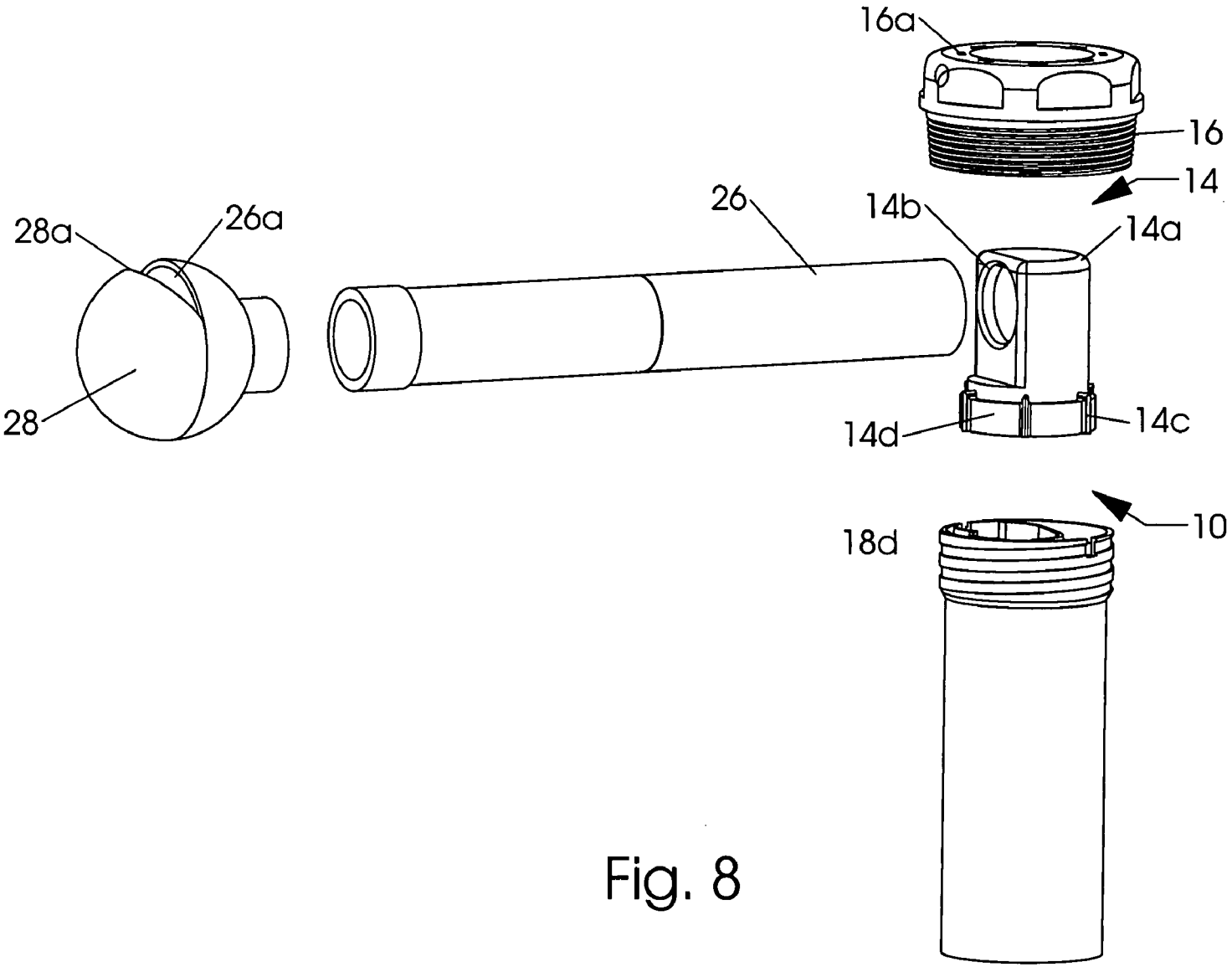
FIG. 8 is an exploded view similar to FIG. 4 except instead depicting the embodiment of FIG. 7.

FIG. 8 is an exploded view similar to FIG. 4 except instead depicting the embodiment of FIG. 7. The depicted embodiment includes an alternative design to means 16 for securing the pool return flow nozzle assembly 10 into a return outlet 32, wherein apertures 16*a* are added. In addition, the rotatable head 14*a* has a plurality of radially spaced-apart ridges or nibs 14*c* configured to allow water flow passage through housing 18*d*, along the passageways 14*d* created the nibs 14*c* through the apertures 16*a* of means 16. See FIG. 9*d* for a larger scale depiction of the combination components of the head 14*a* and means 16.

Figure 9A:
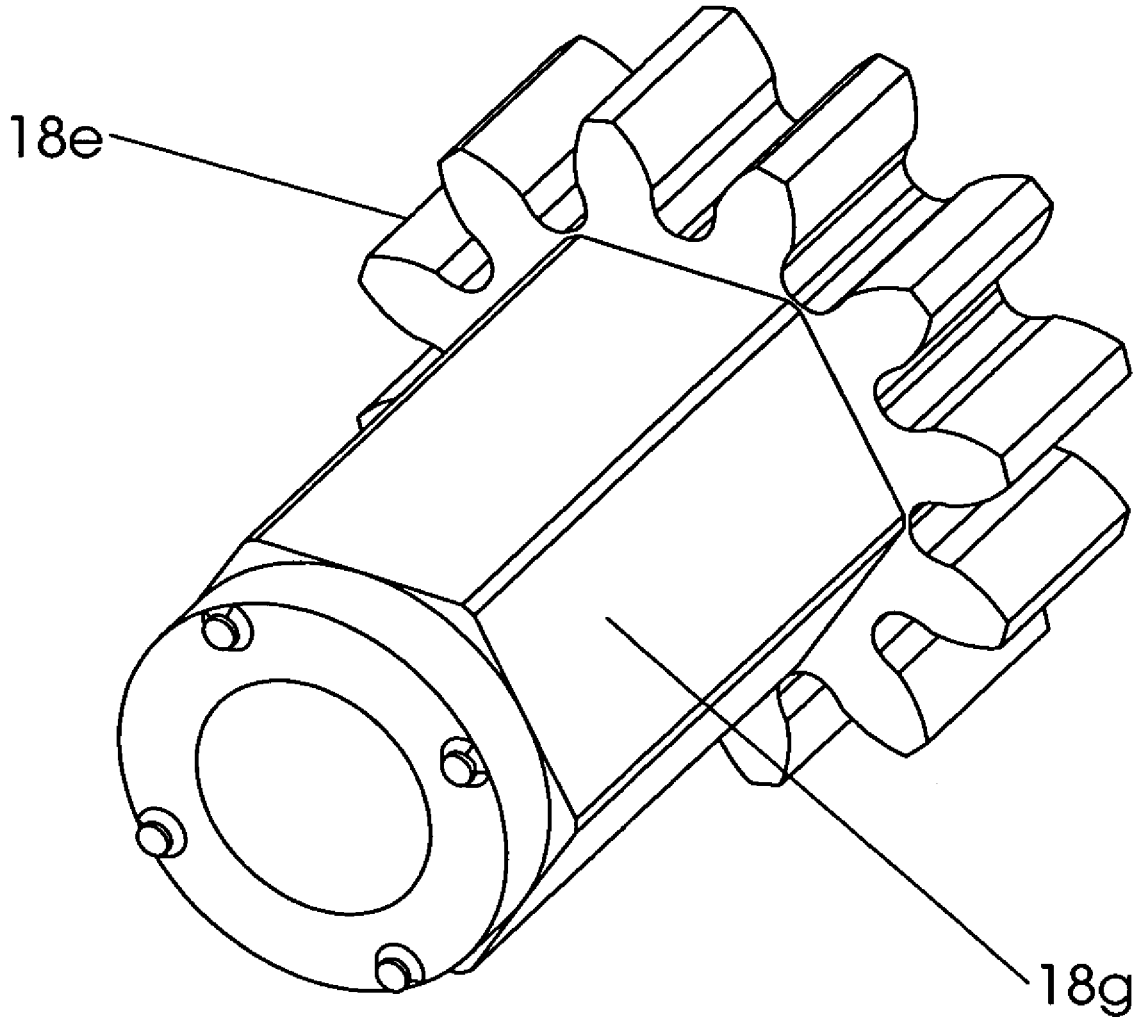
FIG. 9*a* is a depiction of a typical drive gear part with a gear stem portion being formed in a polygonal-shaped instead of a round-shape.

FIG. 9*a* is a depiction of a typical top drive gear part 18*e* of gear system 18*a* with a gear stem portion 18*g* being formed in a polygonal-shaped instead of a round-shape as depicted in FIG. 2. While a round-shaped stem portion works well, the inventor herein found that by using a polygonal-shaped stem portion 18*g*, water was allowed to flow through the resultant void created when the top drive gear part 18*e* was inserted in a round-shaped aperture in the upper gear alignment plate portion or end 18*c*. Rotation is still maintained but the chances of a fine particle of sand lodging in the tolerance spacing between the stem portion 18*g* and aperture in the plate portion 18*c* is significantly reduced.

Figure 9B:
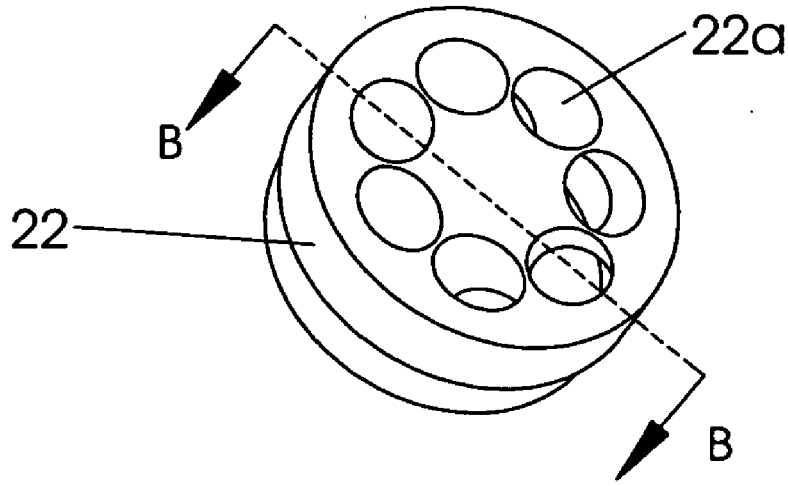
FIG. 9*b* is a depiction of another example of an inlet channeling component similar to that of FIG. 6*a*, which can have apertures aligned with the axis of the invention and angled so as to direct the water more perpendicularly against the typically angled turbine blades.
Figure 9C:
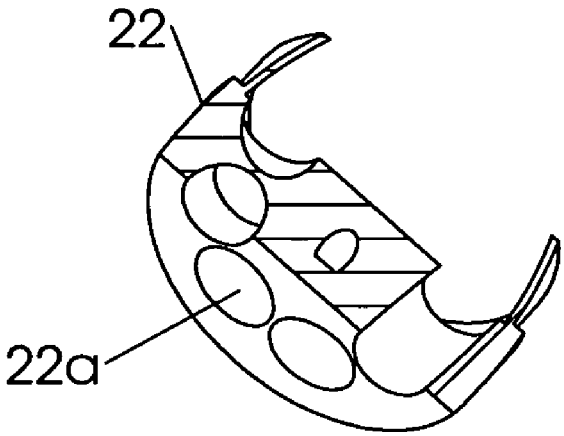
FIG. 9*c* a cross-sectional view of the channeling component depicted in FIG. 9*b;*
Figure 9D:
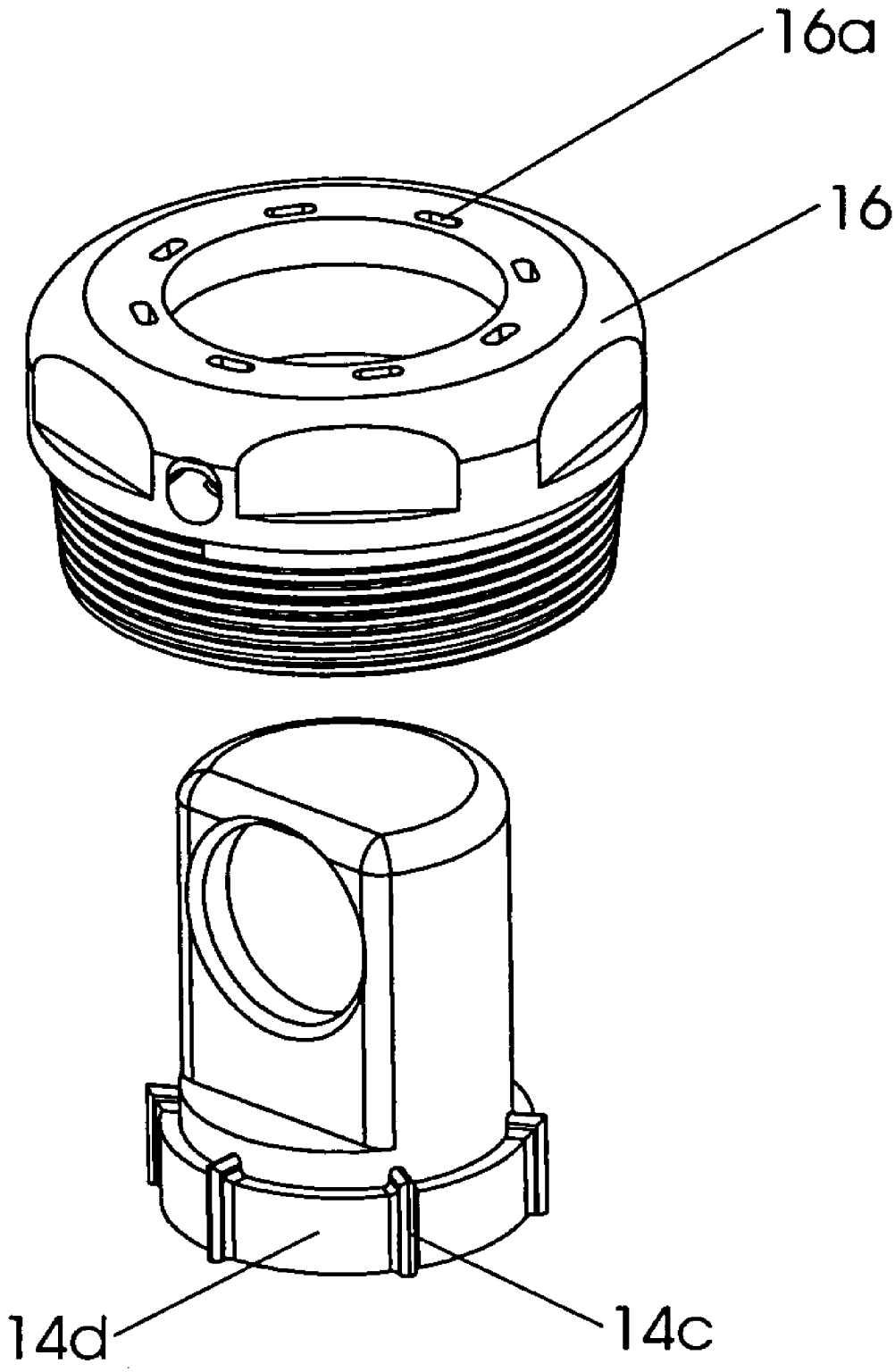
FIG. 9*d* is an exploded view of another example of means for securing the pool return flow nozzle assembly, which may be generically referred to as a nut, with another example design for the rotatable nozzle head.

FIG. 9*b* is a depiction of another example of an inlet channeling component similar to that of FIG. 6*a*, which can have apertures 22*a* aligned with the axis of the invention and angled so as to direct the water more perpendicularly against the typically angled turbine blades. FIG. 9*c* is a cross-sectional depiction taken from line B—B of FIG. 9*b*. Note that the apertures are configured to be larger than that depicted in FIG. 6*a* to allow more water flow. Again, this was found to enhance the self-cleaning characteristics of the invention.

Figure 9F:
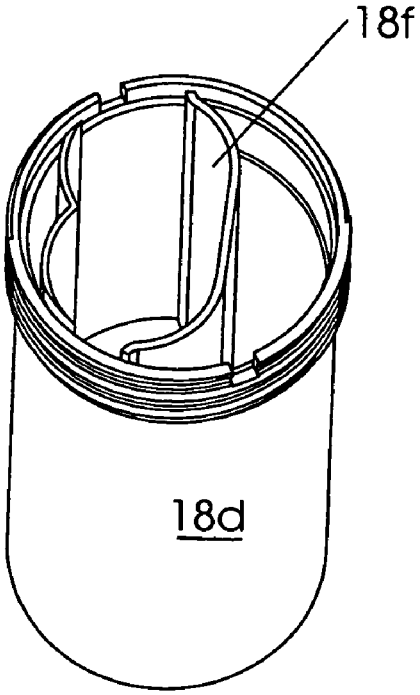
FIG. 9*f* is a perspective view of the housing portion of FIG. 7
Figure 9E:
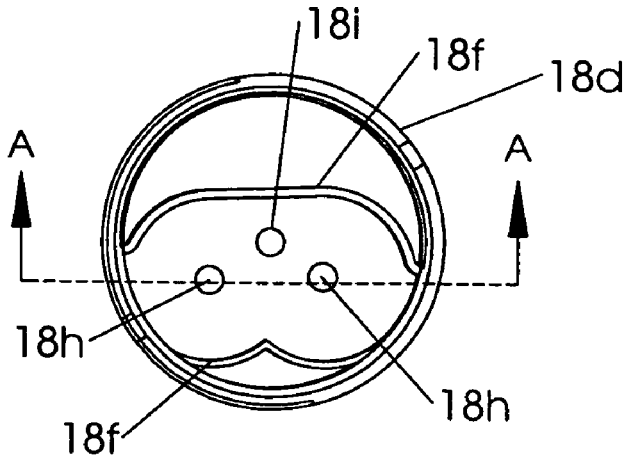
FIG. 9*e* is a plan view of the housing of the embodiment of FIG. 7 further depicting its inside gear encapsulating housing portion.
Figure 9G:
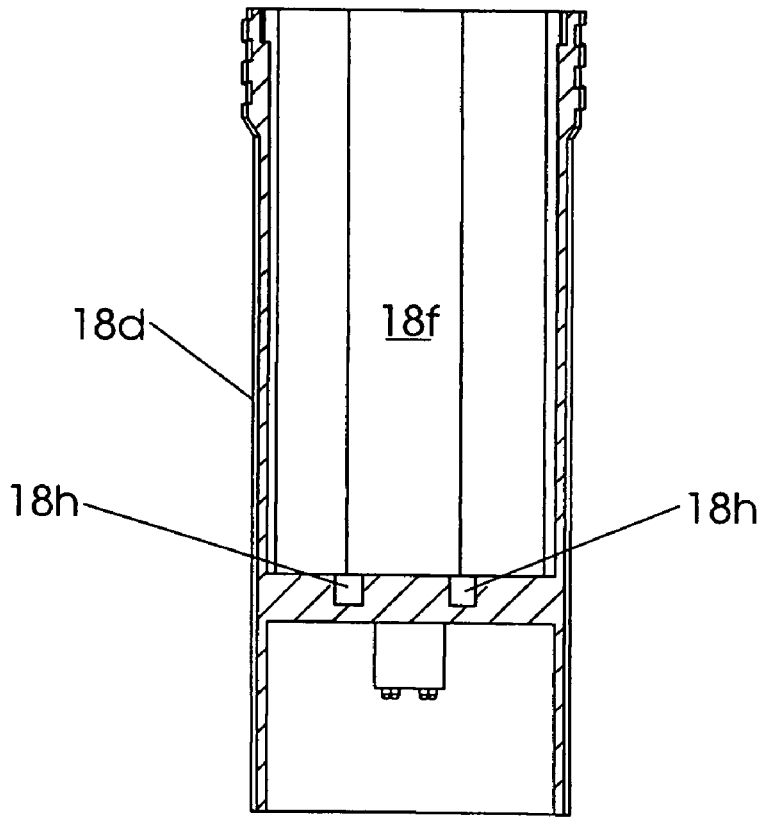
FIG. 9*g* is a cross-section view taken along line A—A of FIG. 9*e;*

FIG. 9*e* is a plan view of the housing 18*d* of the embodiment of FIG. 7 with the upper plate 18*c* and gear system 18 removed for clarity, further depicting its inside gear encapsulating housing portion 18*f*; FIG. 9*f* is a perspective view of the housing 18*d* of FIG. 9*e*, and FIG. 9*g* is a cross-section view taken along line A—A in FIG. 9*e*. Recessed holes 18*h* serve to receive gear shafts 18*b* and aperture 18*i* is the opening through which the shaft 18*b* which is connected to the turbine blade 20*a* is directed. Note that the internal housing 18*f* is configured so that water can flow between the internal housing 18*f* and the housing 18*d* which connects to the nut 16 that further serves as means for securing the invention 10 to the wall of a pool. The internal housing can be shaped along the gear system according to the preference of the designer where one or two passageways around the gears can be created. In the drawing, two passageways are depicted. This is not intended to be a water-tight internal housing so some water is anticipated to flow within the internal housing 18*f*. The internal housing is intended to provide for additional self-cleaning capabilities, thereby directing particulate sand through the invention 10 and minimizing clogging of the gear system with sand. The internal housing 18*f* may be made of solid material or even a fine mesh material.

Figure 10A:
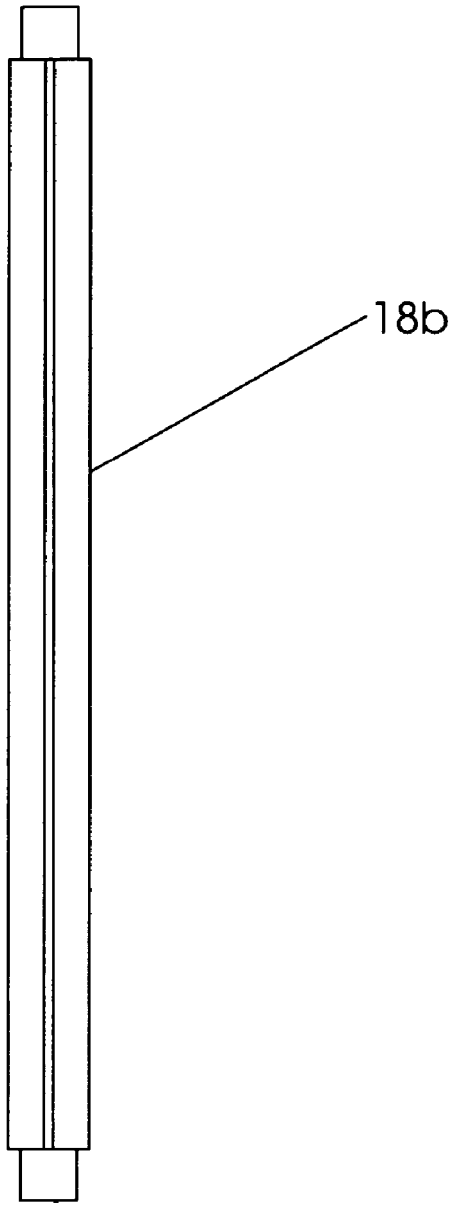
FIG. 10*a* is a side view of a shaft configuration that may be used in the invention.
Figure 10B:
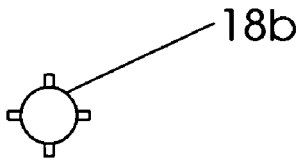
FIG. 10*b* is an end view of the shaft of FIG. 10*a*.

Because fine particulate sand may get lodged between the typically round shaft and the gears through which the shaft is directed, a preferred design for shafts is one that has a X-shaped configuration as depicted in FIGS. 10*a* and 10*b*. This configuration would allow water to more freely pass through the space in the quadrant openings and thereby flush out any sand particles though the invention. Again, this enhances the self-cleaning capabilities of the invention.

To summarize generally regarding how the invention works mechanically, a turbine blade assembly has numerous blades placed at an appropriate angle to turn at the best desirable rate. By the proper directional flow created by the assembly of gear sleeve, the turbine blades will respond and activate the gear assembly.

A turbine blade extension/assembly holds the blades in an appropriate fashion enabling the blades to rotate at a desirable speed. A top plate typically holds the gear assembly together by arms and pins at the appropriate angle for housing.

The gear assembly is properly set, in such a way that by the affect of the turbine blade rotation, which generates motion through the gear chamber at a gear rate as needed, to propel or rotate the rotor head.

The rotor head threaded end piece may be a screw in a collar that holds the entire rotating head in a fixed position. The entire rotary wall fitting is held into place by the male threads screwed into an existing fixed position female threaded adapter. This existing fixed position female threaded adapter receives the unit in that the threads screw into the female adapter, which now maintains the threaded rotor head in a fixed position.

The rotor head sits on top of the threaded rotor head end piece. This rotor head rotates by the operation of the gears at an appropriate rate. The rotating head is internally channeled to allow water to flow freely through the nozzle or outlet. The rotating head nozzle has threads for certain optional attachments. The rotor head moves around steadily by water pressure running through the gear sleeve assembly. The rotor head bearings are sitting on the arm of the rotor head enabling the rotor head to move freely.

The flow tube nozzle is attached to the flow tube assembly. An opening is placed in the distribution head allowing water to flow freely.

Water that is running through existing piping returns back to a swimming pool where the present invention is typically installed. This will allow the returning water to enter the wall fitting end cap and pass through the gear assembly and exit through the rotor head disbursing water on a continuing basis. An optional attachment to a fixed rotor head (by locking the rotating head in place to prevent rotation of the rotor head), allows water to return though the wall fitting, though the flow tube, flowing back into the swimming pool.

It is understood that one skilled in the art may design several gear configurations so that the rotating nozzle turns at a desired rate accomplished by the example of gear configurations presented herein. Therefore, the gear/turbine design shown in the drawings should not be considered as limiting. Although the channeled flue at the inlet to the assembly is desirable to enhance the direction of the water flow against the turbine blades, it too is not necessary. A simple flue with a plurality of apertures in a pre-set array, including a perimeter array of apertures, will accomplish the objective. The angularly directed apertures however produce an enhanced effect. Similarly, the reduction gear assembly can also be accomplished using different arrays of gears, gear pitches and gear teeth. The gear reduction means shown in the drawings is merely one example for obtaining the desired performance of the inventive device.

The total assembly can be made with a variety of materials including polymeric composite materials, metallic materials and combinations thereof.

It should be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention.

What is claimed is:

1. A pool return flow nozzle assembly comprising:

means for diverting a return water from a pool water circulation system back into a pool in a continuous rotating multi-directional pattern;

said means for diverting the return water causing a continuous rotation of a rotatable head assembly at a distal end of the pool return flow nozzle assembly;

said rotatable head assembly including a rotor head having an outlet port through which the return water is directed into the pool in the continuous rotating multi-directional pattern;

the means for diverting the return water includes a water flow driven gear system in mechanical communication with the rotatable head assembly;

means for securing said pool return flow nozzle assembly into a return outlet on a wall of the pool; and means for self-cleaning the pool return flow nozzle using the return water as it flows through the pool return flow nozzle.

2. The assembly according to claim 1, wherein the means for diverting the return water includes a turbine blade assembly in mechanical communication with the water flow driven gear system.

3. The assembly according to claim 2, wherein the means for diverting the return water further includes means for channeling the return water in a desired pattern toward the turbine blades of a turbine blade assembly.

4. The assembly according to claim 3, wherein the means for channeling the return water in the desired pattern includes a plurality of apertures at a proximal end of the means for diverting the return water.

5. The assembly according to claim 4, wherein the plurality of apertures are angularly oriented to direct the water flow toward the turbine blades to enhance the effectiveness of the rotation of the turbine blade assembly.

6. The assembly according to claim 1, further comprising:

locking means for holding the rotor head in a fixed direction when desired.

7. The assembly according to claim 1, further comprising:

a flow tube assembly, said flow tube assembly being securable to the outlet port of the rotor head; and said flow tube assembly having an outlet port at its distal end, said outlet port being in fluid communication with the outlet port on the rotor head.

8. The assembly according to claim 7, wherein said flow tube assembly extends radially from the rotor head a predetermined distance from said rotor head at the distal end of the return flow nozzle assembly.

9. The assembly according to claim 7, wherein the flow tube assembly outlet port includes means for directing the water in a desired pattern back into the pool.

10. The assembly according to claim 9, wherein the means for directing the water in the desired pattern back into the pool includes one or more apertures designed to spray the water back into the pool in a spray pattern, the location, size and number of apertures being selected to obtain a desired aesthetic flow of water through the flow tube assembly outlet port.

11. The assembly according to claim 1, wherein the means for self-cleaning the pool return flow nozzle using the return water as it flows through the pool return flow nozzle comprises:

a plurality of radially spaced-apart nibs around a lower portion of the rotor head; and a plurality of radially spaced-apart apertures in said means for securing said pool return flow nozzle assembly into the return outlet on the wall of the pool, wherein when said rotor head is engaged with said means for securing said pool return flow nozzle assembly into the return outlet on the wall of the pool, return water is allowed to flow through a passageway created by the nibs and through the apertures in said means for securing said pool return flow nozzle assembly into the return outlet on the wall of the pool.

12. The assembly according to claim 1, wherein the means for self-cleaning the pool return flow nozzle using the return water as it flows through the pool return flow nozzle comprises:

means for substantially encapsulating the water flow driven gear system, said means for substantially encapsulating the water flow driven gear system including an internal housing within a housing of the pool return flow nozzle assembly, which is secured to said means for securing said pool return flow nozzle assembly into the return outlet on the wall of the pool, wherein said internal housing is configured to form water passageways between the internal housing and said housing of the pool return flow nozzle assembly.

13. The assembly according to claim 1, wherein the means for self-cleaning the pool return flow nozzle using the return water as it flows through the pool return flow nozzle comprises:

a polygonal-shaped stem portion of a top gear member which engages with the rotor head.

14. The assembly according to claim 1, wherein the means for self-cleaning the pool return flow nozzle using the return water as it flows through the pool return flow nozzle comprises:

X-shaped shafts to which gears of the water flow driven gear system are engaged.

* * * * *